US007467623B2

(12) United States Patent
Turner et al.

(10) Patent No.: US 7,467,623 B2
(45) Date of Patent: Dec. 23, 2008

(54) FUEL DELIVERY SYSTEM

(76) Inventors: Geoffrey Russell Turner, 118 Palm Avenue, Leeton, New South Wales (AU) 2705; James Richard Hunt, 53 Brookfield Way, Cambourne, Cambridge (AU) CB23 5EB ( * ) Notice: Subject to any disclaimer, the term of this patent is extended or adjusted under 35 U.S.C. 154(b) by 0 days.

(21) Appl. No.: 11/662,446

(22) PCT Filed: Sep. 14, 2005

(86) PCT No.: PCT/AU2005/001401

§ 371 (c)(1),
(2), (4) Date: Mar. 9, 2007

(87) PCT Pub. No.: WO2006/029461

PCT Pub. Date: Mar. 23, 2006

(65) Prior Publication Data

US 2007/0261678 A1 Nov. 15, 2007

(30) Foreign Application Priority Data

Sep. 17, 2004 (AU) ..... 2004905389

(51) Int. Cl.
*F02M 23/00* (2006.01)

(52) U.S. Cl. ..... 123/533

(58) Field of Classification Search ..... 123/531–533
See application file for complete search history.

(56) References Cited

U.S. PATENT DOCUMENTS 1,488,254 A * 3/1924 Johnson ..... 15/300.1
2,561,238 A * 7/1951 Smit ..... 137/587
2,794,431 A * 6/1957 Ginnow ..... 123/510
2,891,606 A * 6/1959 Horton ..... 137/209
2,997,102 A * 8/1961 Stearns ..... 137/209
3,592,175 A * 7/1971 Hamilton ..... 123/446
3,845,841 A * 11/1974 Kloefkorn ..... 180/69.4
3,874,471 A * 4/1975 Kloefkorn ..... 180/69.4
4,029,067 A * 6/1977 Giammattei ..... 123/530
4,041,695 A 8/1977 Harper et al.
4,164,919 A * 8/1979 Davis et al. ..... 123/434
4,240,381 A * 12/1980 Lowther ..... 123/26
4,319,550 A 3/1982 Ishii et al.
4,519,356 A * 5/1985 Sarich ..... 123/533
5,526,795 A * 6/1996 Thompson et al. ..... 123/516
5,666,927 A * 9/1997 Pace et al. ..... 123/533
5,975,055 A * 11/1999 Matsuda et al. ..... 123/472
6,215,624 B1 4/2001 Summers et al.
6,675,583 B2 1/2004 Willis et al.
6,868,808 B2 * 3/2005 Holder et al. ..... 123/3

FOREIGN PATENT DOCUMENTS

DE 27 35 822 A1 2/1979
EP 0 186 262 7/1986
GB 1 578 306 11/1980

* cited by examiner

*Primary Examiner*—Thomas N Moulis
(74) *Attorney, Agent, or Firm*—Hoffmann & Baron, LLP

(57) ABSTRACT

A fuel delivery system is disclosed which includes a purge device which comprises a compressor (30) which includes a tank (32) for supplying compressed air to a line (34) which is connected to a fuel line (24). The compressed air is supplied to a point between a fuel tank (22) and a pump (26) to push fuel back into the tank (22) or through the pump (26) then through an injector (20) and back through a return line (28) to the tank so that the fuel line is completely purged of fuel.

5 Claims, 1 Drawing Sheet

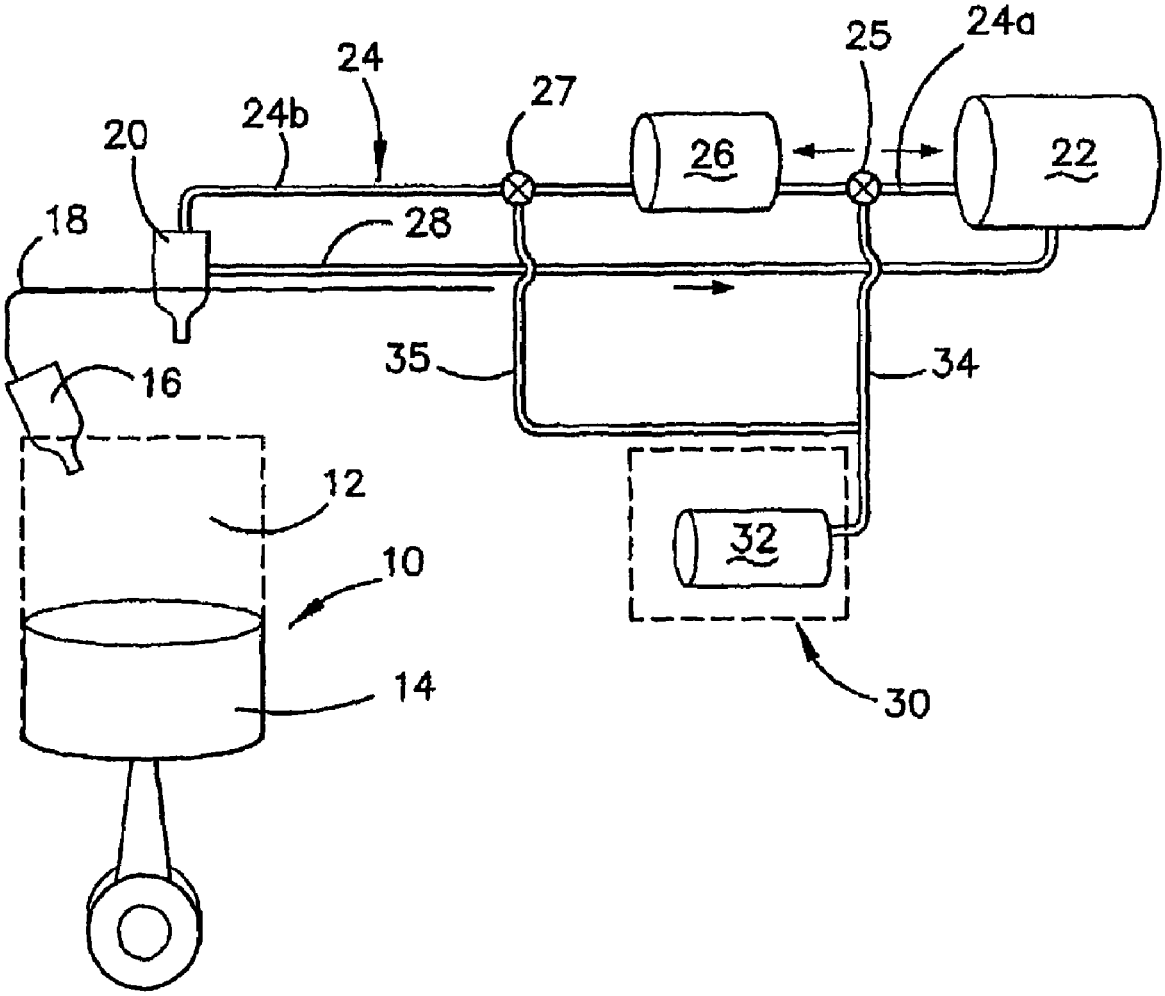
24
24b
20
18
16
12
10
14
27
28
26
25
24a
22
35
34
32
30

FUEL DELIVERY SYSTEM

CROSS-REFERENCE TO RELATED APPLICATIONS:

This application is the National Stage of International Application No. PCT/AU2005/001401, filed Sep. 14, 2005, which claims the benefit of Australian Application No. AU 2004905389, filed Sep. 17, 2004, the contents of which is incorporated by reference herein.

FIELD OF THE INVENTION

This invention relates to a fuel delivery system for a vehicle engine.

BACKGROUND OF THE INVENTION

The most common form of fuel delivery system for a vehicle is systems which deliver a single fuel to the vehicle engine, such as petrol or gasoline, diesel or LPG. In more recent times, systems have been proposed for delivering alternatively petrol and LPG. Thus, these systems usually have some sort of switch over mechanism so that the vehicle engine can run only on petrol and then can be switched so that the vehicle engine runs only on LPG.

International Patent Applications PCT/AU02/00453 and PCT/AU03/000971 disclose systems in which a primary fuel such as diesel and a secondary fuel such as LPG are concurrently fed to the vehicle engine.

The nature of fuels which are available for delivery to engines and the way in which they are delivered presents specific problems which need to be addressed when designing the fuel delivery system.

SUMMARY OF THE INVENTION

The present invention may be said to reside in a fuel delivery system for a vehicle engine, comprising:

- a tank for supplying fuel;
- a supply device for supplying the fuel to a cylinder of the engine;
- a fuel line extending between the tank and the device; and
- a purging device for purging fuel from the fuel line after shut down of the engine.

Thus, the system according to the invention enables fuels to be delivered through the fuel line which, if left in the fuel line for long periods after vehicle shut down, may damage the fuel line. Such a fuel may be ethanol or the like which can corrode or otherwise damage the fuel line if the ethanol is left in the fuel line for a lengthy period after shut down. By purging the fuel from the fuel line, the fuel line is protected, and therefore the life expectancy of the fuel line and the fuel delivery system is improved.

In the preferred embodiment of the invention the purging device purges the fuel from the fuel line so that the fuel is returned to the tank.

In one embodiment of the invention the supply device comprises an injector for injecting the fuel into the engine air inlet manifold or port.

In another embodiment the supply device may simply be a carburation type system in which the fuel is delivered to the air intake for the engine and delivered into the cylinder with the inlet air.

In the most preferred form of the present invention the supply device comprises an injector for delivering the fuel and a second injector for delivering a second fuel concurrently with the fuel.

Preferably the second fuel is diesel.

The injector for delivering the fuel may be an injector constructed in accordance with the aforementioned International applications, the contents of which are incorporated into this specification by this reference.

Preferably the purging device comprises a compressor and compressed air reservoir for supplying compressed air to the fuel line to force the fuel from the fuel line.

Preferably the fuel line includes a pump for drawing the fuel from the tank and supplying the fuel through the fuel line.

Most preferably the compressor and compressed air reservoir is connected by an air supply line to a first part of the fuel line between the tank and the pump and by an ancillary fuel line to a second part of the fuel line between the pump and the supply device, the fuel line having a return line from the supply device to the tank so that the supply of compressed air to the first part forces the air in the first part either directly to the tank or through the pump to the second part of the fuel line, and the ancillary air line forces the fuel through the second part of the air line, the supply device and the return line back to the tank.

BRIEF DESCRIPTION OF THE DRAWING

A preferred embodiment of the invention will be described, by way of example, with reference to the accompanying drawing.

DETAILED DESCRIPTION OF THE PREFERRED EMBODIMENT

With reference to the drawing, a fuel delivery system for delivering fuel to a vehicle engine schematically shown at 10 is provided. The engine 10 includes a plurality of cylinders 12, each having a piston 14. In the drawing only one cylinder 12 and piston 14 is represented.

An injector 16 is provided for supplying diesel fuel from a diesel fuel supply line 18 to the cylinder or cylinders of the engine. Typically each cylinder will have its own injector 16 for separately delivering fuel to each of the separate cylinders 12.

The supply line 18 connects to a tank of diesel fuel (not shown) and the injectors 16 and supply line 18 act in the conventional way and therefore will not be described in any further detail herein. However, regard can be had to the abovementioned International applications for details of how the diesel injectors 16 and 18 operate with concurrent delivery of another fuel.

In the preferred embodiment of the invention, a second fuel is also provided to the engine air inlet port and to cylinders 12 by an injector 20. In the preferred embodiment the second fuel is ethanol. However, other fuels such as methanol, etc. could also be used.

The injector 20 may be a conventional injector for delivering liquid type fuels, but most preferably is an injector constructed in accordance with the aforementioned International applications.

In a still further arrangement, the supply of the fuel could be by way of a carburation system, although use of fuel injection is much more preferred.

The fuel delivery system includes a fuel tank 22 for maintaining a supply of the methanol fuel and a fuel supply line 24 for delivering the fuel from the tank 22 to the injector 20. A pump 26 is provided in the line 24 for drawing fuel from the tank 22 and supplying the fuel to the injector 20.

A return line 28 is provided between the injector 20 and the fuel tank 22. A compressor 30 which includes a tank 32 for maintaining a supply of compressed air is provided and a first air line 34 delivers air to a first part 24*a* of the fuel line 24 which extends between the tank 22 and the pump 26. A valve 25 may be provided for delivering the compressed air into the line 24*a* when required. An ancillary fuel supply line 35 is provided for delivering compressed air to part 24*b* of the fuel line 24 between the pump 26 and the injector 20. Once again, a valve 27 can be provided for supplying the compressed air from the line 35 into the fuel line 24.

When the vehicle engine is switched off, the lines 34 and 35 supply compressed air to the line 24 to purge the line 24 of fuel. The air which is supplied from the line 34 will push the fuel either back into the tank 22 or through the pump 26, as is shown by the arrows in the drawing, and the air from the line 35 will tend to continue pushing the fuel so that it circulates through the injector 20, the return line 28 and back to the tank 22. Thus, the fuel line 24 and also the return line 28 is completely purged of fuel so that the fuel does not sit in the fuel line 24 between engine shut down and the next engine start up so the fuel will not damage the fuel line 24.

In the preferred embodiment of the invention, the valves 25 and 27 are controlled by a controller, which may be the engine CPU to provide a signal to open the valves when the engine is shut down so that the air is supplied as described above.

Since modifications within the spirit and scope of the invention may readily be effected by persons skilled within the art, it is to be understood that this invention is not limited to the particular embodiment described by way of example hereinabove.

What is claimed is:

1. A fuel delivery system for a vehicle engine, comprising:

a tank for supplying fuel;

a fuel supply device for supplying fuel to a cylinder of the engine;

a fuel line extending between the tank and the fuel supply device;

a fuel pump connected into the fuel line between the tank and the fuel supply device for drawing fuel from the tank and pumping it to the fuel supply device; and a fuel line purging device for purging fuel from the fuel line after shut down of the engine;

wherein said fuel in device comprises an air a compressor and compressed air reservoir for supplying compressed air to the fuel line, a first air supply line connecting the compressor and compressed air reservoir to a first part of the fuel line between the tank and the fuel pump, a second air supply line connecting the compressor and compressed air reservoir to a second part of the fuel line between the fuel pump and the fuel supply device, and a fuel purge line extending between the fuel supply device and the tank, whereby supply of compressed air to the first part of the fuel line via the first air supply line will force any fuel in that first part of the fuel line either directly to the tank or through the fuel pump into the second part of the fuel line, and supply of compressed air to the second part of the fuel line via the second air supply line will force any fuel in that second part of the fuel line through the fuel supply device and the fuel purge line back to the tank.

2. The system of claim 1 wherein the supply device comprises an injector for injecting the fuel into an air inlet manifold or port of the engine.

3. The system of claim 1 wherein the fuel supply device is a carburetion type system in which the fuel is delivered to an air intake for the engine and delivered into the cylinder with inlet air.

4. The system of claim 1 wherein the fuel supply device comprises a first injector for delivering the fuel and a second injector for delivering a second fuel concurrently with the first said fuel.

5. The system of claim 4 wherein the second fuel is diesel.

* * * * *